US007704443B2

(12) United States Patent
Lepish et al.

(10) Patent No.: US 7,704,443 B2
(45) Date of Patent: Apr. 27, 2010

(54) CARBOTHERMIC ALUMINUM PRODUCTION APPARATUS, SYSTEMS AND METHODS

(75) Inventors: Joseph A. Lepish, Pittsburgh, PA (US); Gerald E. Carkin, Tarentum, PA (US)

(73) Assignees: Alcoa, Inc., Pittsburgh, PA (US); Elkem AS, Olso (NO)

( * ) Notice: Subject to any disclaimer, the term of this patent is extended or adjusted under 35 U.S.C. 154(b) by 203 days.

(21) Appl. No.: 11/950,300

(22) Filed: Dec. 4, 2007

(65) Prior Publication Data

US 2009/0139371 A1 Jun. 4, 2009

(51) Int. Cl.

| | |
|---|---|
| ***C22B 9/00*** | (2006.01) |
| ***H05B 3/60*** | (2006.01) |
| ***F27D 1/12*** | (2006.01) |
| ***H05B 7/06*** | (2006.01) |

(52) U.S. Cl. ..... 266/171; 373/53; 373/73; 373/76; 373/88

(58) Field of Classification Search ..... 266/171; 373/53, 73, 88, 76

See application file for complete search history.

(56) References Cited

U.S. PATENT DOCUMENTS

| | | | | |
|---|---|---|---|---|
| 1,206,057 | A | 11/1916 | Eckermann et al. | 373/66 |
| 1,317,327 | A | 9/1919 | Shoeld | 75/10.27 |
| 2,829,961 | A | 4/1958 | Miller et al. | 75/674 |
| 2,974,032 | A | 3/1961 | Grunert et al. | 75/10.27 |
| 3,230,072 | A | 1/1966 | Johnson | 75/10 |
| 3,607,221 | A | 9/1971 | Kibby | 75/10.21 |
| 3,971,653 | A | 7/1976 | Cochran | 75/10.27 |
| 4,033,757 | A | 7/1977 | Kibby | 75/10.27 |
| 4,080,511 | A | 3/1978 | Collin | 13/33 |
| 4,089,640 | A * | 5/1978 | Overmyer et al. | 432/73 |
| 4,099,959 | A | 7/1978 | Dewing et al. | 75/10.27 |
| 4,226,618 | A | 10/1980 | Dewing et al. | 75/10.27 |
| 4,261,736 | A | 4/1981 | Dewing et al. | 75/674 |
| 4,299,619 | A | 11/1981 | Cochran et al. | 75/10.27 |
| 4,334,917 | A | 6/1982 | Kibby | 75/10.27 |
| 4,388,107 | A | 6/1983 | Kibby | 75/10.27 |

(Continued)

FOREIGN PATENT DOCUMENTS

| | | |
|---|---|---|
| CA | 1185435 | 4/1985 |

(Continued)

OTHER PUBLICATIONS

Bruno, M., *Aluminum Carbothermic Technology*, Final Technical Progress Report for the Period Jul. 2000 through Dec. 2004.

(Continued)

*Primary Examiner*—George Wyszomierski
*Assistant Examiner*—Tima M McGuthry-Banks
(74) *Attorney, Agent, or Firm*—Greenberg Traurig, LLP

(57) ABSTRACT

Apparatus, systems and methods for carbothermically producing aluminum are disclosed. The systems may include a reactor and an electrical supply. The reactor may include a plurality of side-entering electrodes and a top-entering electrode. The electrical supply may be operable to supply multiphase current to the side-entering electrodes and/or the top-entering electrodes. The electrodes may be in communication with a molten bath of the reactor, and the multiphase current supplied thereto may be passed through the bath to heat the reactor. The amount of current supplied to various electrode sets may be adjusted to facilitate tailored heating of the molten bath.

19 Claims, 11 Drawing Sheets

U.S. PATENT DOCUMENTS

| | | | | |
|---|---|---|---|---|
| 4,399,544 | A | 8/1983 | Monaghan | 373/35 |
| 4,409,021 | A | 10/1983 | Moore | 75/10.27 |
| 4,441,920 | A | 4/1984 | Wilkening | 75/10.27 |
| 4,486,229 | A | 12/1984 | Troup et al. | 75/10.21 |
| 4,491,472 | A | 1/1985 | Stevenson et al. | 75/10.21 |
| 4,533,386 | A | 8/1985 | Kibby | 75/10.27 |
| 4,624,003 | A | 11/1986 | Eirich et al. | 373/120 |
| 4,995,051 | A | 2/1991 | Hakulin et al. | 373/81 |
| 5,479,435 | A * | 12/1995 | Yoshida et al. | 373/81 |
| 5,513,206 | A | 4/1996 | Mori et al. | 373/80 |
| 5,908,564 | A | 6/1999 | Titus et al. | 219/121.36 |
| 6,124,028 | A | 9/2000 | Nagle et al. | 428/308.8 |
| 6,440,193 | B1 | 8/2002 | Johansen et al. | 75/10.27 |
| 6,530,970 | B2 | 3/2003 | Lindstad | 75/10.27 |
| 6,805,723 | B2 | 10/2004 | Aune et al. | 75/10.27 |
| 6,980,580 | B2 | 12/2005 | Aune et al. | 373/61 |
| 2002/0170387 | A1 | 11/2002 | Lindstad | 75/10.27 |
| 2004/0173053 | A1 | 9/2004 | Aune et al. | 75/10.27 |
| 2006/0042413 | A1 | 3/2006 | Fruehan | 75/10.27 |

FOREIGN PATENT DOCUMENTS

| | | |
|---|---|---|
| DE | 3405273 | 9/1985 |
| FR | 2152440 | 4/1973 |
| WO | WO 2005/022060 | 3/2005 |
| WO | WO2005056843 | 6/2005 |

OTHER PUBLICATIONS

Johansen et al., *Carbothermic Aluminum: Alcoa and Elkem's New Approach Based on Reactor Technology to meet Process Requirements*, Proceedings 6th International Conference on Molten Slags, Fluxes and Salts, (Jun. 12-17, 2000).

*Simple Technologies for Charcoal Making*, FAO Forestry Department, FAO Forest Paper 41, pp. 1-7, Rome, Italy (1987).

International Search Report and Written Opinion mailed Feb. 25, 2009 from corresponding International Application No. PCT/US2008/084176.

* cited by examiner

CARBOTHERMIC ALUMINUM PRODUCTION APPARATUS, SYSTEMS AND METHODS

BACKGROUND

Aluminum metal is generally manufactured by two techniques: the traditional Hall method, where an electric current is passed between two electrodes to electrolytically reduce alumina to aluminum metal; and the carbothermic method, where aluminum oxide is chemically reduced to aluminum via chemical reaction with carbon. The overall aluminum carbothermic reduction reaction:

$$Al_2O_3+3C \rightarrow 2Al+3CO \quad (1)$$

takes place, or can be made to take place, via a series of chemical reactions, such as:

$$2Al_2O_3+9C \rightarrow Al_4C_3+6CO(vapor) \quad (2)$$

$$Al_4C_3+Al_2O_3 \rightarrow 6Al+3CO(vapor) \quad (3)$$

$$Al_2O_3+2C \rightarrow Al_2O(vapor)+2CO(vapor) \quad (4)$$

$$Al_2O_3+4Al \rightarrow 3Al_2O(vapor) \quad (5)$$

$$Al \rightarrow Al(vapor) \quad (6)$$

Reaction (2), generally known as the slag producing step, often takes place at temperatures between 1875° C. and 2000° C. Reaction (3), generally known as the aluminum producing step, often takes place at temperatures above about 2050° C. Aluminum vapor species may be formed during reactions (2) and (3), although aluminum vapor species may be formed via reactions (4), (5), and (6).

SUMMARY OF THE DISCLOSURE

Broadly, the instant disclosure relates to systems and methods for carbothermically producing aluminum. The systems and methods may employ a top-entering electrode and a plurality of side-entering electrodes. Alternating current may be utilized in conjunction with the electrodes, which may facilitate efficient production of aluminum.

According to one aspect of the disclosure, a system for carbothermically producing aluminum is provided, the system including a carbothermic reactor and an electrical supply. The carbothermic reactor comprises a chamber adapted to contain a molten bath, the chamber being at least partially defined by an outer shell and a floor of the carbothermic aluminum production reactor. A set of side-entering electrodes penetrate the outer shell and are in communication with the chamber. A single top-entering electrode is in communication with the chamber, and the top-entering electrode is moveable in the up-down directions. In one embodiment, a cover that substantially covers the chamber is utilized. The cover includes a first port for receiving the single top-entering electrode. In one embodiment, the cover includes at least one additional port for receiving feedstock to be fed to the chamber.

The electrical supply is in electrical communication with the set of side-entering electrodes. In one approach, the electrical supply includes an electrical generator adapted to supply a different voltage phase to each electrode of the set of side-entering electrodes. In one approach, the electrical supply is adapted to impose phase shifting with respect to each electrode of the set of electrodes. In one embodiment the electrical supply is operable to supply an equal amount of each voltage phase to each electrode. In one embodiment the electrical supply is operable to supply an adjustable amount of each voltage phase to each electrode. In one embodiment, when the top-entering electrode is in a first position, and during operation of the reactor, at least some current from the electrical supply passes through the molten bath in delta configuration. In one embodiment, when the top-entering electrode is in a second position, and during operation of the reactor, at least some current passes through the molten bath in a Wye configuration.

The reactor may include an inner wall interconnected with the cover and extending toward the floor of the reactor. In one embodiment, the inner wall at least partially circumscribes a portion of the top-entering electrode. In another embodiment, the inner wall completely circumscribes a portion of the top-entering electrode. In one embodiment, the inner wall is interconnected with a cooling supply system. In one embodiment, the inner wall includes at least one passageway adapted to flow a coolant therethrough. In one embodiment, the inner wall comprises at least one aperture that completely penetrates the wall, and the at least one aperture is in fluid communication with the at least one additional port of the cover, thereby facilitating passage of off-gas from the chamber to the at least one additional port during operation of the reactor.

In one approach, a feeder is fluidly interconnected with the at least one additional port. The feeder may be operable to feed feedstock to the reactor via the at least one additional port, thereby facilitating interaction between off-gas exiting the reactor and feedstock entering the reactor. In one embodiment, the feeder comprises a moveable member located proximal the at least one additional port. The moveable member may be operable to push the feedstock into the at least one additional port. In one embodiment, the feeder comprises a heater for preheating the feed materials prior to supply to the reactor. In one embodiment, the feeder comprises a hopper.

In one approach, a plurality of electrode sets are utilized. In one embodiment, the system includes a first set of electrodes and a second set of electrodes. The relative heights and/or spacing of the electrodes may be varied, between sets or within sets. In one embodiment, the first set of electrodes is aligned with a first horizontal plane, and the second set of electrodes is aligned with a second horizontal plane. In one embodiment, the first horizontal plane is different than the second horizontal plane. In one embodiment, the electrodes are spaced equidistance about the perimeter of outer shell of the reactor. The electrical system may be configured to operate each set of electrodes independently.

Methods of operating carbothermic aluminum production reactors are also provided. In one aspect, the method includes the steps of generating a molten bath and off-gas within the carbothermic reactor, supplying feedstock to the carbothermic production reactor via a feedstock supply path, flowing off-gas into the feedstock supply path, and removing at least a portion of the aluminum species from the off-gas phase via interaction of the off-gas and the feedstock. The molten bath may include at least one of aluminum metal, aluminum carbide and slag. The off-gas may include aluminum vapor species and carbon monoxide. The feedstock supply path may be defined by a port in a cover of the carbothermic aluminum production reactor, a top-entering electrode communicable with the molten bath, and an inner wall circumscribing the top-entering electrode.

In one approach, the molten bath is generated/maintained by flowing multiphase current therethrough. In one embodiment, the molten bath is generated/maintained by passing multiphase current between a plurality of side-entering electrodes in communication with the molten bath. In one embodiment, the molten bath is generated/maintained by flowing alternating current from at least one of the side-entering electrodes to the top-entering electrode. In one embodiment, the method includes positioning the top-entering electrode in a first vertical position, where a first amount of alternating current may flow into to the top-entering electrode. In turn, the method may include moving, concomitant to the generating step, the top-entering to a second vertical position, where a second amount of alternating current may flow to the top-entering electrode.

In one approach, the supplying feedstock step comprises pre-conditioning the feedstock prior to supplying the feedstock to the molten bath. In one embodiment, the supplying step includes pre-heating the feedstock in a pre-heating zone located external to the feedstock supply path. For example, the feedstock may be heated to a temperature of at least about 100° C. prior to entering the feedstock supply path, such as via the above-described feeder. The feedstock may also be heated/conditioned while the feedstock is in the reactor, but before the feedstock is supplied to the molten bath (e.g., via the feedstock supply path). In one embodiment, the method includes heating the feedstock to a temperature of at least about 600° C. while the feedstock is located within the feedstock supply path. In one embodiment, the method includes heating the feedstock to a temperature below the melting point of the feedstock materials (e.g., not greater than about 1900° C.) while the feedstock is located within the feedstock supply path. In one embodiment, aluminum oxide and a carbonaceous material of the feedstock may react to create aluminum carbide while the feedstock is located within the feedstock supply path.

As noted, the method may include generating off-gas during operation of the reactor. In one embodiment, the method includes generating a first portion of off-gas outside the perimeter of the inner wall that circumscribes a portion of the top-entering electrode. In turn, the method may include flowing at least some of the first portion of the off-gas into the feedstock supply path via an aperture located in the inner wall.

As noted, the method may include removing at least some aluminum species from the generated off-gas. In one embodiment, the removing step includes reacting at least some aluminum species with carbonaceous material of the feedstock. In a related embodiment, the removing step includes condensing at least some aluminum species on a surface of the feedstock. In one approach, the method includes cooling the inner wall via an external coolant supply, such as via flowing coolant through at least one passageway located within the inner wall. In turn, the removing aluminum-containing vapors step may include condensing aluminum vapor species on a surface of the inner wall.

As may be appreciated, various ones of the inventive aspects noted hereinabove may be combined to yield various carbothermic reactors and associated systems. These and other aspects, advantages, and novel features of the disclosure are set forth in part in the description that follows and will become apparent to those skilled in the art upon examination of the following description and figures, or may be learned by practicing the disclosure.

DETAILED DESCRIPTION

Figure 1:
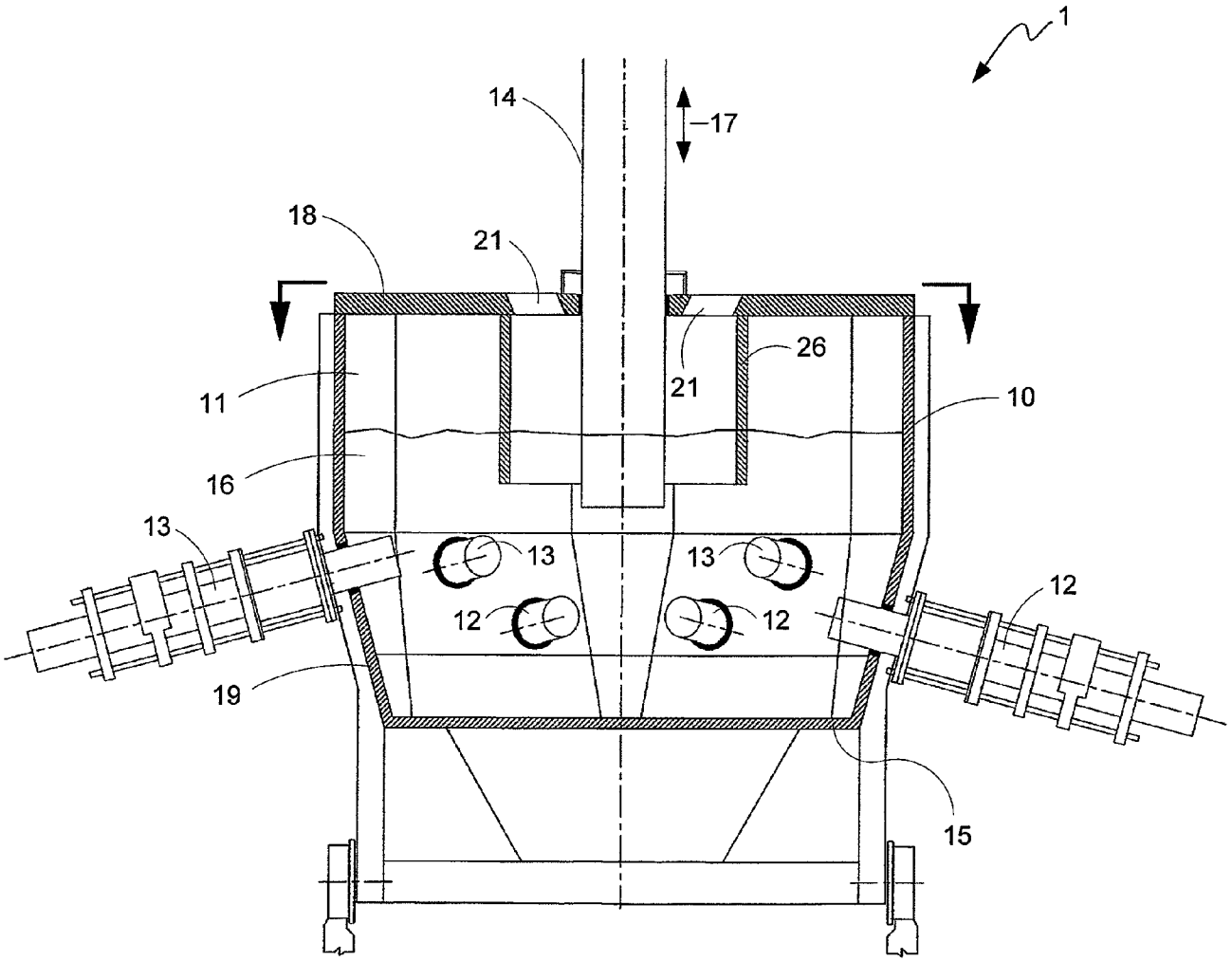
FIG. 1 is a sectional view of one embodiment of a carbothermic reactor.
Figure 2:
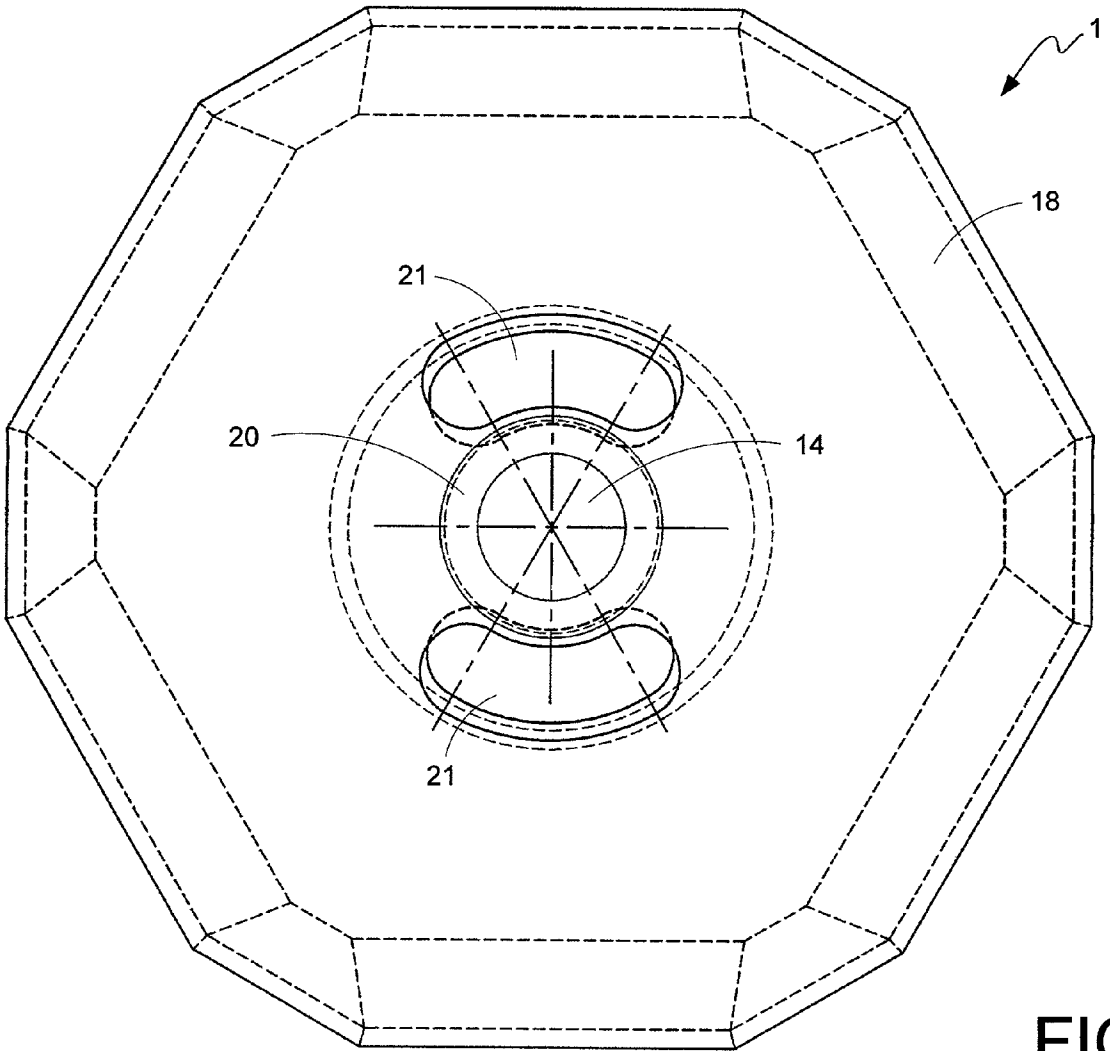
FIG. 2 is a top view of the carbothermic reactor of FIG. 1.

Reference will now be made in detail to the accompanying drawings, which at least assist in illustrating various pertinent embodiments of the present disclosure. FIGS. 1 and 2 illustrate one embodiment of a carbothermic reactor (also known as a carbothermic furnace) for carbothermically producing aluminum. In the illustrated embodiment, the reactor 1 comprises an outer shell 10 and a floor 15 defining, at least in part, a chamber 11 adapted to contain a molten bath 16. The reactor 1 further includes a plurality of side-entering electrodes 12, 13 that penetrate the outer shell 10 and are in communication with the molten bath 16. In the illustrated embodiment, a first set of electrodes 12 is located at a first height relative to the floor 15, and a second set of electrodes 13 is located at a second, higher height level relative to the floor 15. The reactor 1 further includes a single top-entering electrode 14 in communication with the chamber 11, the top-entering electrode 14 being movable in the up-down directions, as indicated by arrow 17. The reactor 1 also includes a cover 18 substantially covering the chamber 11. The cover 18 includes at least a first port 20 for receiving the single top-entering electrode 14. The cover 18 also includes at least one additional port 21 for receiving feedstock (not illustrated) to be fed to the chamber 11.

In operation, multiphase current from an electrical supply (not illustrated) may be supplied to the electrodes 12, 13 and passed through the molten bath 16 to produce aluminum metal. In particular, multiphase current may be utilized to resistively heat the molten bath 16 to temperatures within the range of from about 1875° C. to about 2200° C. to facilitate production of aluminum metal. In one embodiment, the reactor 1 may be operated within the temperature range of from about 1875° C. to 2000° C. to produce aluminum-carbide and aluminum-carbide containing slag. The reactor 1 may be operated within the temperature range of from about 2050° C. to 2200° C. to produce aluminum metal from the aluminum-carbide and aluminum-carbide containing slag. The reactor 1 may be operated within the temperature range of from about 1900° C. to 1950° C. to extract carbon from the produced aluminum metal. Various off-gas and various species (e.g., $Al_2O$, Al, CO) may be produced during operation of the reactor 1.

Figure 3:
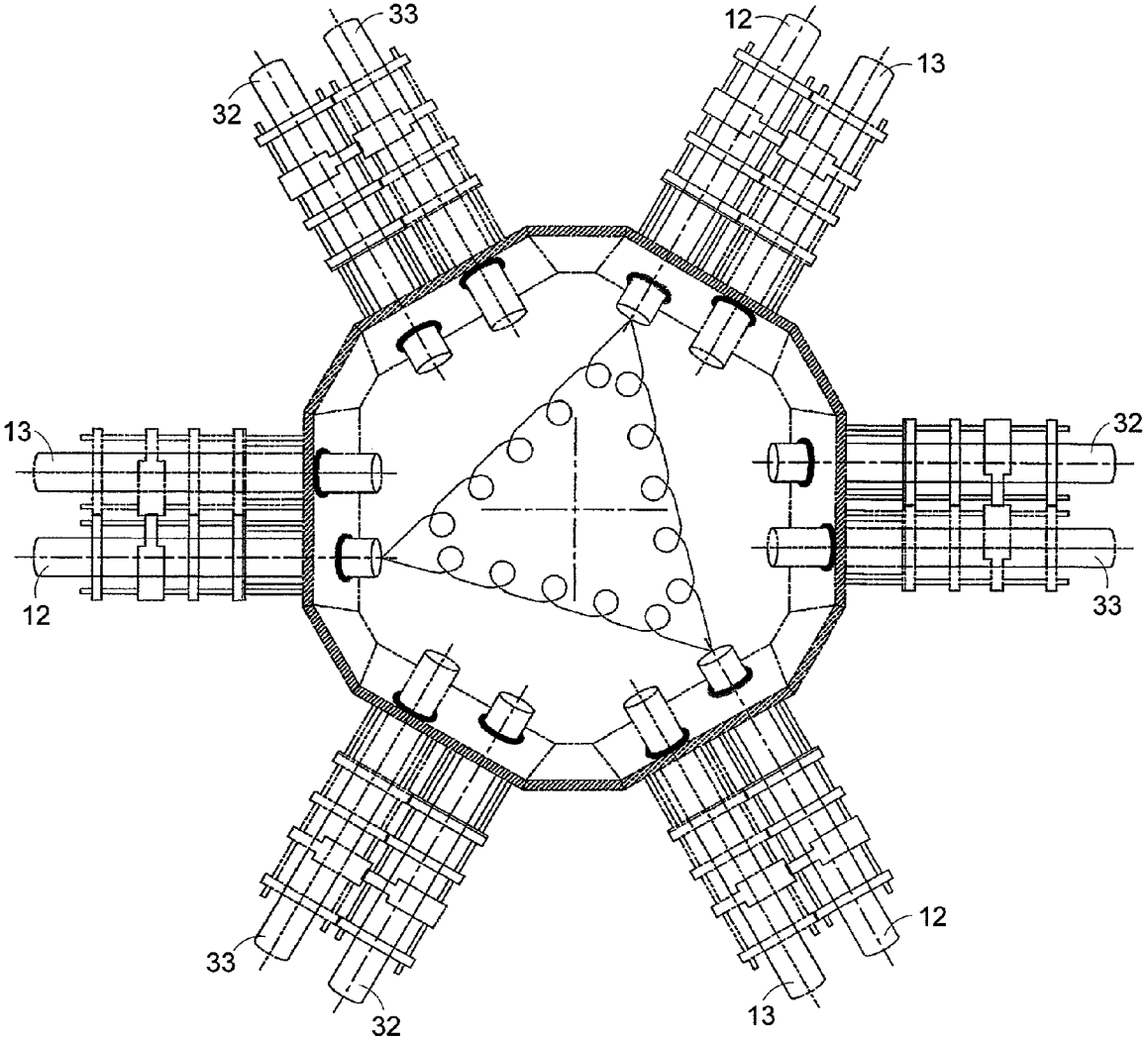
FIG. 3 is a schematic view of one embodiment of current flow between a first set of side-entering electrodes of a carbothermic reactor.
Figure 4:
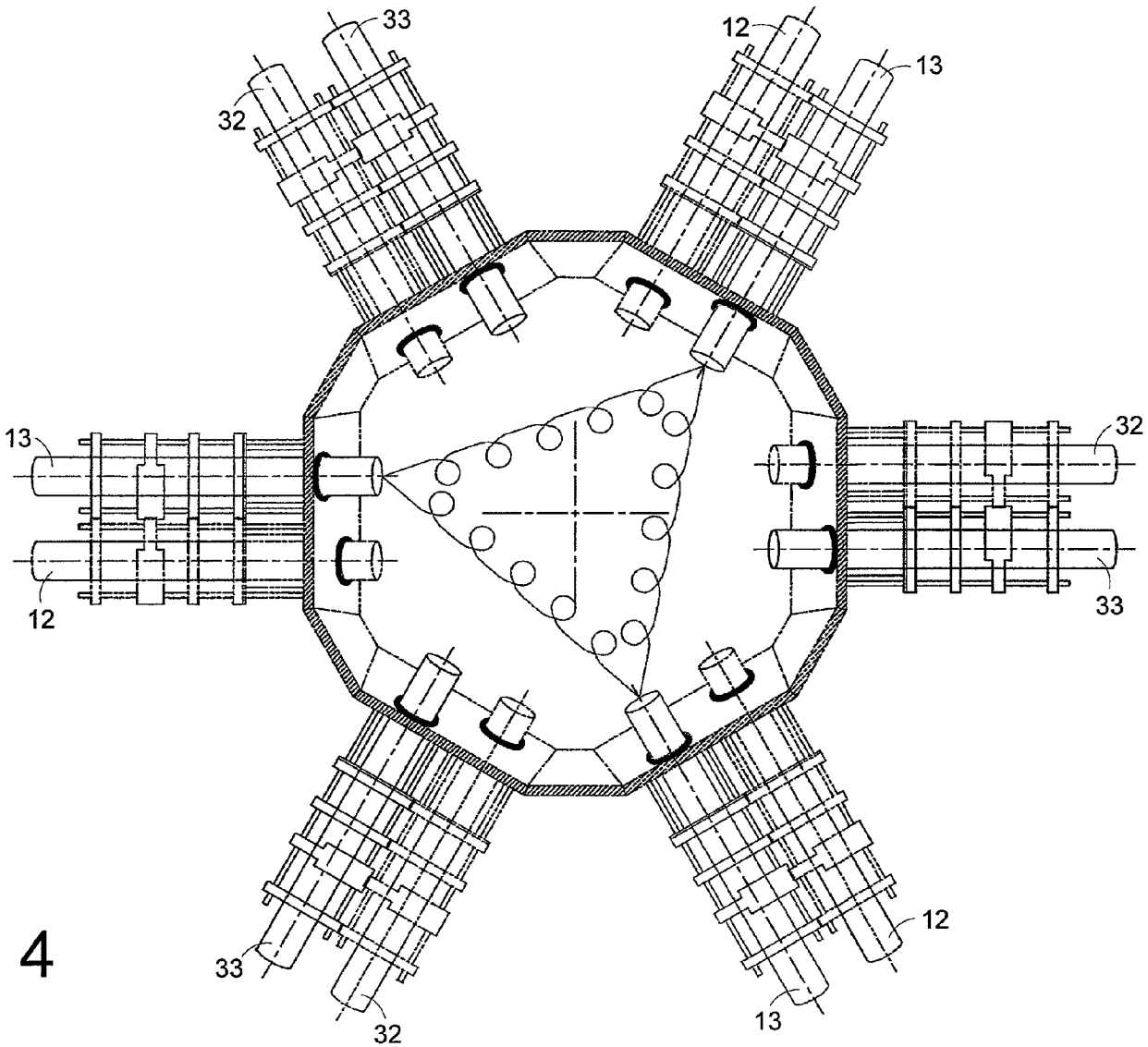
FIG. 4 is a schematic view of one embodiment of current flow between a second set of side-entering electrodes of a carbothermic reactor.

In one mode of operation, multiphase current is passed through the molten bath 16 in a delta configuration. As illustrated in FIG. 3, multiphase current may be supplied to and shared between the first set of electrodes 12, thereby facilitating heating of molten bath 16, such as a lower portion of molten bath 16. As illustrated in FIG. 4, in turn, multiphase current may be supplied to and shared between the second set of electrodes 13, thereby facilitating heating of molten bath 16, such as an upper portion of molten bath 16. In particular, a first amount of current may be passed through the molten bath 16 via the first set of electrodes 12 during a first sequence. In turn, a second amount of current may be passed through the molten bath 16 via the second set of electrodes 13 during a second sequence. Hence, differing current flow paths within the bath may be realized. In particular, current flowing between the first set of electrodes 12 may flow at a first height relative to the floor 15 to heat a first portion (e.g., a lower, lower-middle, or middle portion) of the molten bath 16, and current flowing between the second set of electrodes 13 may flow at a second height relative to the floor 15 to heat another portion (e.g., a middle, upper-middle, or upper portion) of the molten bath 16. Furthermore, different amounts of current may be supplied to each electrode set. Hence, variable electrical intensity within the reactor may be achieved.

In the illustrated embodiment, a third set of electrodes 32 and a fourth set of electrodes 33 are included with the reactor 1, the third set of electrodes 32 being horizontally aligned with the first set of electrodes 12, and the fourth set of electrodes 33 being horizontally aligned with the second set of electrodes 13. One or more of these electrode sets 33, 34, and/or additional sets of electrodes, may optionally be utilized to further facilitate electrical current distribution in the molten bath 16, thereby facilitating more uniform and efficient heating of the molten bath 16. Moreover, various electrode sets may be aligned in horizontal and/or vertical directions to facilitate varying current distribution through the molten bath 16.

In the illustrated embodiments, three electrodes per set are utilized, and the electrodes are equally spaced about the perimeter of the reactor 1. In turn, three differing voltage phases may be supplied to each electrode of the set of electrodes. Phase shifting may also be employed. Other configurations may also be utilized. For instance, six electrodes per set may be utilized and six differing voltage phases may be supplied to each electrode of the set of electrodes. The amount of electrodes per set is generally application dependent. Each set of electrodes may be operated independently of the other sets of electrodes.

In the illustrated embodiment, a plurality of side entering electrode sets are employed. However a single set of side entering electrodes may be employed.

As noted, the electrodes may be arranged in any suitable manner to facilitate operation of the carbothermic reactor. In the illustrated embodiment of FIG. 1, the outer shell 10 includes a lower tapered portion 19 interconnected to the floor 15. Such lower tapered portion 19 is useful for positioning the tips of the electrodes 12, 13 closer to the center axis of the reactor 1. In turn, heat generated at the electrode tips will flow into a more central portion of the molten bath 16, thereby reducing heat losses realized at the outer shell. Hence, operating efficiencies may be increased.

Use of multiphase current in conjunction with the side-entering electrodes 12, 13 provides advantages over previous carbothermic reactor designs. For example, the use of multiphase current, as opposed to direct current, allows utilization of higher current loads within the reactor 1, which facilitates higher wattage intensities. In turn, fewer electrodes may be required for a given reactor size, thereby reducing capital costs and complexity of the reactor.

The amount of current provided to the reactor 1 may also be tailored relative to the particular processing step. For example, a plurality of the sets of side-entering electrodes (e.g., 12, 13, 32, and/or 33) may be utilized during start-up of the reactor 1. If the reactor is operated in batch mode (e.g., production of aluminum-carbide and slag, followed by production of metal, optionally followed by carbon extraction from the aluminum metal, followed by removal of the aluminum metal from the reactor), during slag making, multiple sets of the side-entering electrodes may be utilized to further facilitate uniform production of aluminum carbide within the molten bath 16. Alternatively, lower and/or middle oriented sets of side-entering electrodes may be predominantly utilized during operations so as to lower the amount of current passed through, and hence lower the temperature of, the upper portion of the molten bath 16. In turn, lower vapor production rates may be realized. Similarly, multiple sets of side-entering electrodes may be utilized during metal making to facilitate temperatures suitable for reduction of aluminum carbide to aluminum metal and carbon, but, as with slag making, lower and/or middle oriented sets of side-entering electrodes may be predominantly utilized so as to control heating of the upper portion of the molten bath 16. Likewise, multiple sets of side-entering electrodes may be utilized during carbon extraction to facilitate temperatures suitable for extraction of carbon from the metal phase to the slag phase, but, as with slag and metal making, lower and/or middle oriented sets of side-entering electrodes may be predominantly utilized so as to control heating of the upper portion of the molten bath 16. Middle and/or upper side-entering electrodes may be intermittently utilized during these steps to achieve desired temperatures and/or temperature gradients within the molten bath 16. If the reactor 1 is operating in a continuous mode, discussed in further detail below, one or more sets of the side-entering electrodes may be operated as appropriate to achieve the desired conditions within the reactor. Hence, use of a plurality of sets of side-entering electrodes and multiphase current facilitates tailored operation of the reactor so as to create the desired temperature and/or temperature gradients within the molten bath.

Electromagnetic stirring of the molten bath 16 may also be facilitated. In one approach, a first set of electrodes may flow current through the bath in a first path (e.g., clockwise). In turn, a second set of electrodes may flow current through the bath coincidental to the first path (e.g., similarly clockwise) or in a different path (e.g., counterclockwise). Due to the electromagnetic effects of supplying alternating current via differing electrodes, tailored stirring of the molten bath may be facilitated. In one approach, stirring of the molten bath is effected via cooperative current flow paths. In a related approach, motion of the molten bath (e.g., agitation, stirring) may be reduced by non-cooperative current flow paths that are countercurrent to the direction of flow of the molten bath via one or more of the set(s) of side-entering electrodes. Thus, tailored molten bath mixing intensities and flow directions may be achieved.

Multiphase current may be supplied to the side-entering electrodes 12, 13 and/or top-entering electrode 14 to facilitate production of the molten bath 16, such as heating the molten bath 16 to appropriate temperatures. Electrical current generally flows through the molten bath 16 in the delta configurations of FIGS. 1, 3 and 4 when the top-entering electrode 14 is in a first position, such as when the top-entering electrode 14 is elevated relative to the molten bath 16. However, when the top-entering electrode 14 is in a second position (e.g., a position lower than the first position, such as when a portion of the top-entering electrode 14 is submerged in the molten bath 16), at least some current may flow from one or more of the side-entering electrodes 12, 13 into the top-entering electrode 14 to facilitate alternative current distribution paths within the molten bath 16. In particular, the top-entering electrode 14 may be lowered into the molten bath 16 during operation of one or more of the set(s) of side-entering electrodes 12, 13. In turn, at least some of the current provided to the side-entering electrodes 12, 13 may flow to the top-entering electrode 14 (e.g., a Wye configuration of current flow). Thus, the top-entering electrode 14 may be utilized to facilitate current distribution within the molten bath 16. In one embodiment, current provided to the side-entering electrodes 12, 13 may flow to the top-entering electrode 14 when the top-entering electrode 14 is sufficiently proximal the side-entering electrodes 12, 13, thereby allowing the power intensity within the molten bath 16 to be readily varied, such as with varying height of the top-entering electrode 14. The power intensity may be varied to achieve various reactor conditions or in response to various reactor conditions. For example, the power intensity may be varied due to resistance variations in the slag phase or molten aluminum metal phase, or due to changes in the amount of carbon contained within the molten bath.

The top-entering electrode 14 may be used to facilitate start-up of the reactor 1. In particular, the top-entering electrode may be moved in the up-down directions to facilitate mechanical massaging of the charge. The top-entering electrode may also be positioned to receive electrical current from one or more side-entering electrodes, thereby allowing current to flow through the start-up charge (e.g., alumina and/or carbon starting materials) of the reactor 1 in various directions and provide more uniform heating. In one embodiment, the resultant electrical flow can shift from a delta resistive load to a Wye/delta combination. The closer the tip of the top-entering electrode is to the floor 15, the more the load shifts toward a Wye resistive load, which generates more heat at the top-entering electrode. In addition, the phase currents can be adjusted to facilitate additional current flow through the top-entering electrode. In one embodiment, the tip of the top-entering electrode may be resistively heated via receipt of the current, which may further assist in heating the start-up charge. When the charge reaches a suitable temperature, the top-entering electrode may be moved to another position (e.g., higher relative to the bath, or removed from the bath). The up-down movement functionality of the top-entering electrode 14 may be utilized concomitant with the electrical receipt functionality of the top-entering electrode 14. Thus, the top-entering electrode 14 may physically massage the initial charge/molten bath 16 while facilitating current flow therethrough.

Figure 5:
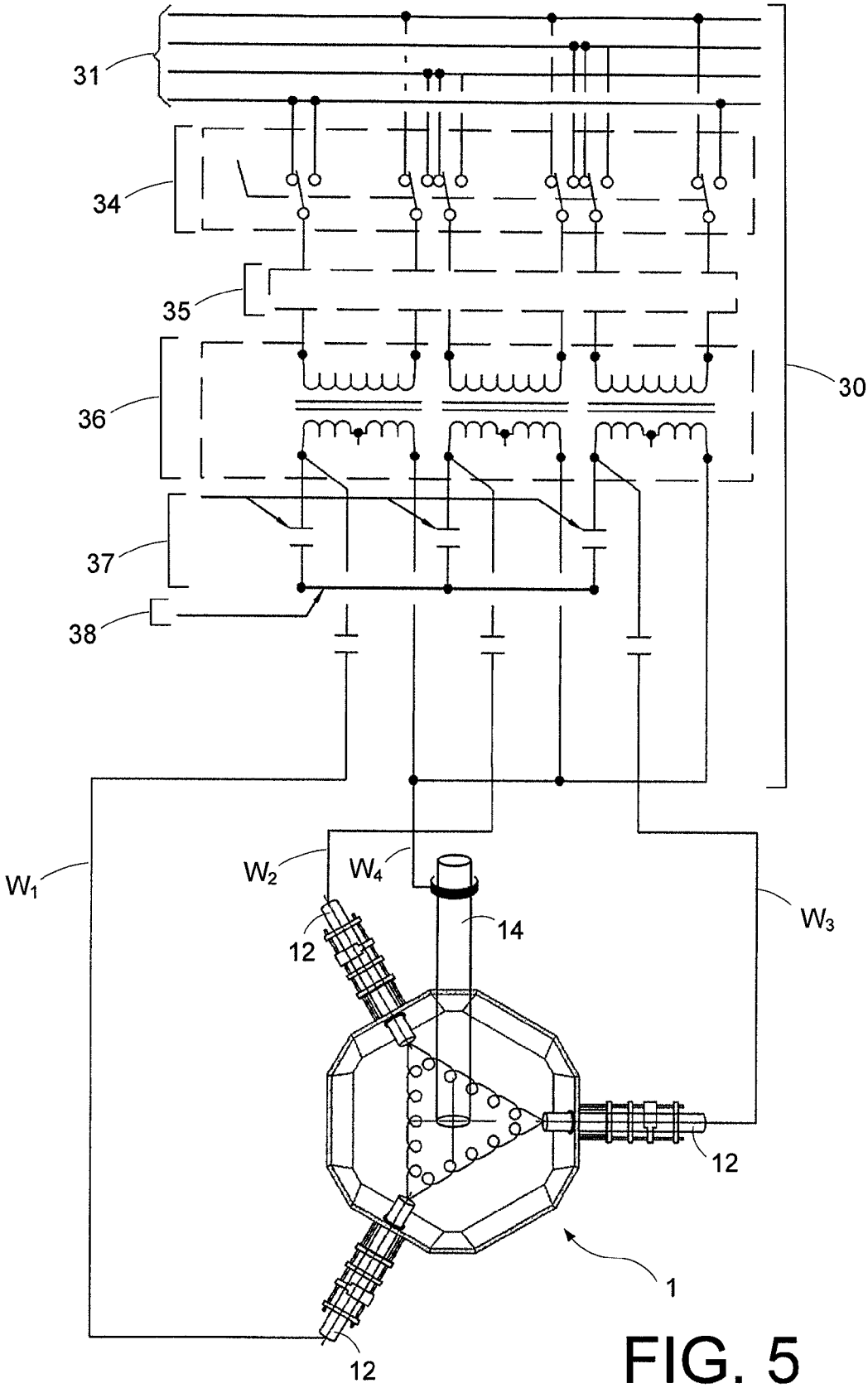
FIG. 5 is a schematic view of one embodiment of a carbothermic reactor and an electrical supply arrangement.

One embodiment of an electrical supply for facilitating current supply/distribution is illustrated in FIG. 5. In the illustrated embodiment, the electrical supply 30 is electrically interconnected to a first set of electrodes 12 via wires $W_1$-$W_3$. The electrical supply 30 is further electrically interconnected to the single top-entering electrode 14 via wire $W_4$. The electrical supply 30 comprises various components to facilitate electrical current distribution and supply to the side-entering electrodes 12 and/or the top-entering electrode 14 of the reactor 1. In particular, the electrical supply 30 comprises a power feed 31, a switch 34, a multi-tap changer 35, a power transformer 36, a high current switch 37, and a bonding bus 38. This configuration facilitates supply of current to the side-entering electrodes 12 and receipt of current from the single top-entering electrode 14. Similar configurations may be utilized to supply power to electrodes 13, 32 and/or 33, and receipt of current from the single top-entering electrode 14. The present configuration of the electrical supply 30 also facilitates supply of current to the top-entering electrode 14, in certain instances. More particularly, the high-current switch 37 and bonding bus 38 arrangement allows current to be switched from the side-entering electrodes 12 to the top-entering electrode 14. Supply of current to the top-entering electrode 14 may be utilized, for example, during start-up of the reactor 1, as noted above. Transformer phase shifting, or other isolation or control techniques, may be utilized if more than one set of electrodes is utilized during supply of current to the top-entering electrode 14.

Aside from the current distribution benefits of using a top-entering electrode, other advantages may also be realized. For instance, since the top-entering electrode 14 is moveable in the up-down directions (e.g., via exterior mechanical means), the top-entering electrode 14 may be used to further facilitate mixing of the molten bath 16 due to its physical interaction with the molten bath 16. In one embodiment, the top-entering electrode 14 may be submerged in the molten bath 16, thereby displacing and raising the level of the molten bath 16 within the reactor 1, such as during tapping operations. In this embodiment, a metal exit (not illustrated) may be disposed within an upper portion of the outer shell 10. When the level of the molten bath 16 raises (e.g., via submersion of the top-entering electrode 14), molten metal disposed near the top of the molten bath 16 may flow out of the reactor 1 via the metal exit.

Figure 6:
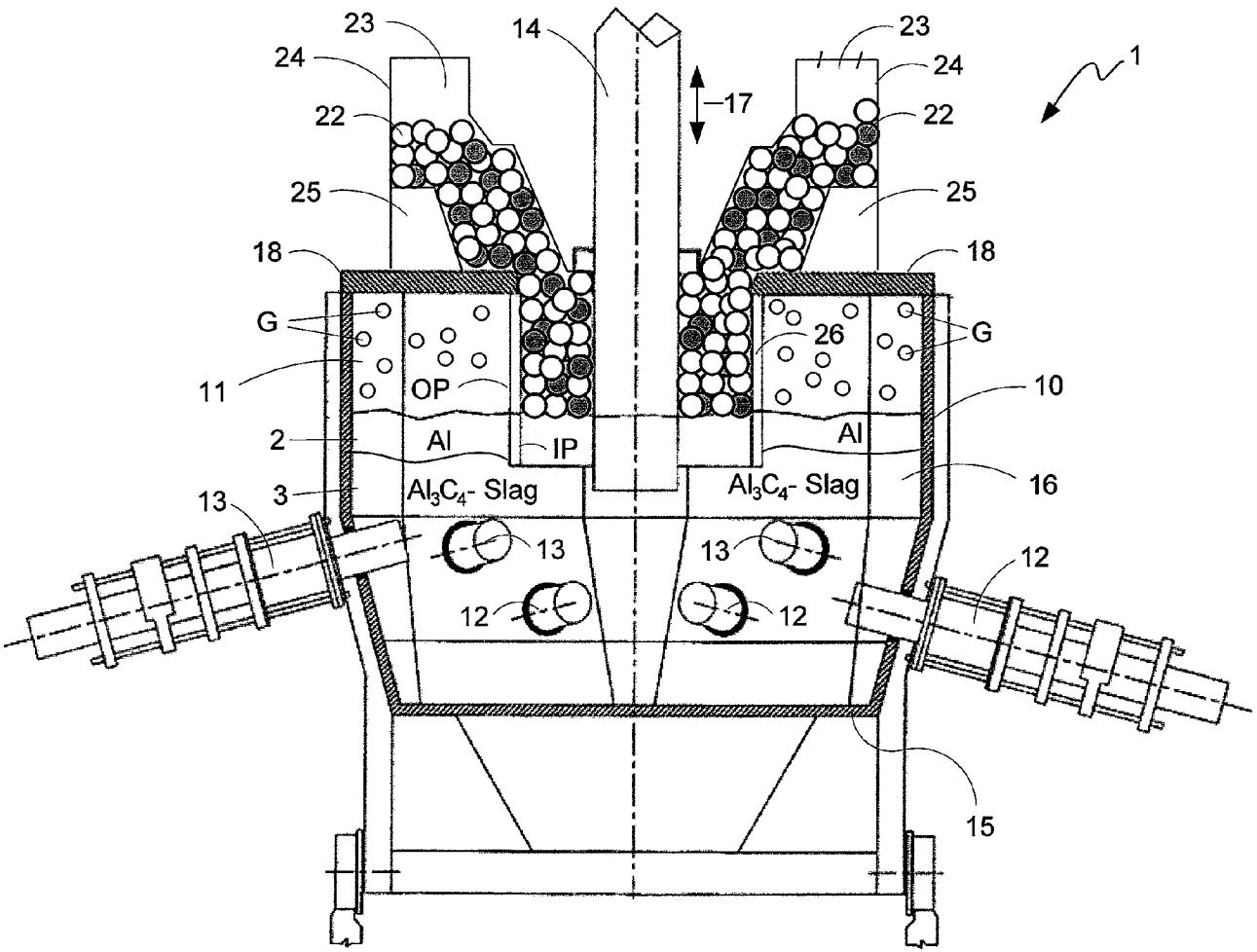
FIG. 6 is a sectional view of one embodiment of a carbothermic reactor having a feeder interconnected therewith.

Referring back to FIG. 1 and as noted above, the cover 18 may include one or more ports 21 for receiving feed materials to be fed to the reactor 1. Various devices and methods may be utilized for feeding feedstock to the reactor 1, via the ports 21, such as via a simple hopper. However, it is often useful to pre-condition the feedstock prior to supplying the feedstock to the reactor 1. Hence, in one embodiment, a pre-conditioning feeder is interconnected to the reactor 1 for supply of pre-conditioned feedstock to the reactor. One embodiment of a reactor/pre-conditioning feeder arrangement is illustrated in FIG. 6. In the illustrated embodiment, a pre-conditioning feeder 24 is interconnected with the cover 18 of the reactor 1, and includes one or more passageways 23 ("passageway(s)") interconnected with ports 21 of the cover 18. Feedstock 22 is fed to the reactor 1 via the passageway(s) 23 and ports 21. The feedstock 22 may comprise, for example, alumina and carbonaceous materials. The feeder 24 may comprise a heater (not illustrated) for heating the feedstock 22 so as to pre-condition the feedstock to an appropriate temperature, such as a temperature in the range of from 100° C. to about 1900° C. (e.g., just below its melting point). Thus, the passageway(s) 23 may act as preheating zones. The feeder 24 may also comprise one or more moveable members 25 ("moveable member(s)") for facilitating supply of the feedstock 22 to the ports 21. In particular, the moveable member(s) 25 may be at least partially contained within the passageway(s) 23 and operable to push feedstock 22 into ports 21. The moveable member(s) 25 may include a tapered face for facilitating distribution of feedstock 22 within the passageway(s) 23.

The reactor 1 may also include an inner wall 26 that at least partially circumscribes, and often completely circumscribes, a portion of the top-entering electrode 14, thereby providing an annular space between an outer surface of top-entering electrode 14 and the inner wall 26. The inner wall 26 may be interconnected with the cover 18 and may extend towards the floor 15 of the reactor 1. The inner wall may extend a distance such that a bottom portion of the inner wall 26 is submerged in the molten bath 16. Thus, the inner wall 26 may at least partially segregate the top-entering electrode 14 from molten aluminum metal phase 2 produced during operation of the reactor 1. In turn, reduced current flow to the aluminum metal phase 2 may be realized, thereby restricting production of off-gas G during operation of the reactor 1. More aluminum metal may thus be produced during operations without short circuiting. In one embodiment, continuous metal production is facilitated via an overflow methodology, wherein feedstock 22 is continuously supplied to the reactor 1, aluminum carbide and slag phase 3 and aluminum metal phase 2 are continuously produced therefrom, via the above-described reactions, and the produced aluminum metal flows out of the reactor 1 via a metal exit (not illustrated) located in an upper portion of the outer shell 10. In this regard, lower/middle electrodes may be operated at a first wattage to heat the lower/middle portions of the aluminum carbide-slag 3 to appropriate slag making temperatures, while middle/upper electrodes may be operated at a second wattage to heat the middle/upper portions of the aluminum carbide-slag to appropriate metal making temperatures.

In one embodiment, a cooling system (not illustrated) may be fluidly interconnected with the inner wall 26 to cool the inner wall 26 so as to further restrict production of off-gas G in contact therewith. In particular, passageways, or other suitable apparatus (not illustrated), may be included within the inner wall 26 to facilitate flow of coolant therethrough. Such passageways or other apparatus may be disposed proximal the outer perimeter OP of the inner wall 26 (e.g., away from inner perimeter IP) so as to facilitate cooling of the molten aluminum metal phase with restricted cooling of feedstock 22 located proximal the inner perimeter IP of the inner wall 26.

The inner wall 26, port 21 and outer surface of the top-entering electrode 14 may define a feedstock supply path for supplying feedstock 22 to the molten bath 16 of the reactor 1. Thus, the feedstock supply path may be changeable (e.g., via movement of the top-entering electrode 14), and its length may be tailored to fit its application. The feedstock supply path may be segregated from at least a portion of the molten aluminum metal via the inner wall 26. In turn, restricted interaction between the feedstock 22 and aluminum metal phase 2 may be realized, thereby decreasing the amount of aluminum metal that, due to thermodynamics, returns to aluminum carbide. Hence, increased metal production efficiency may be realized. The top-entering electrode 14 may be moved in the up-down directions to massage feedstock 22 in the feedstock supply path to restrict agglomeration of the feedstock 22 and bridging of the feedstock 22. Use of the feedstock supply path is also useful in that the feedstock 22 in the feedstock supply path provides a place for in-situ heating of the feedstock 22 and may reduce radiant heat losses to the cover 18, thereby providing further reactor operating efficiencies.

Figure 7:
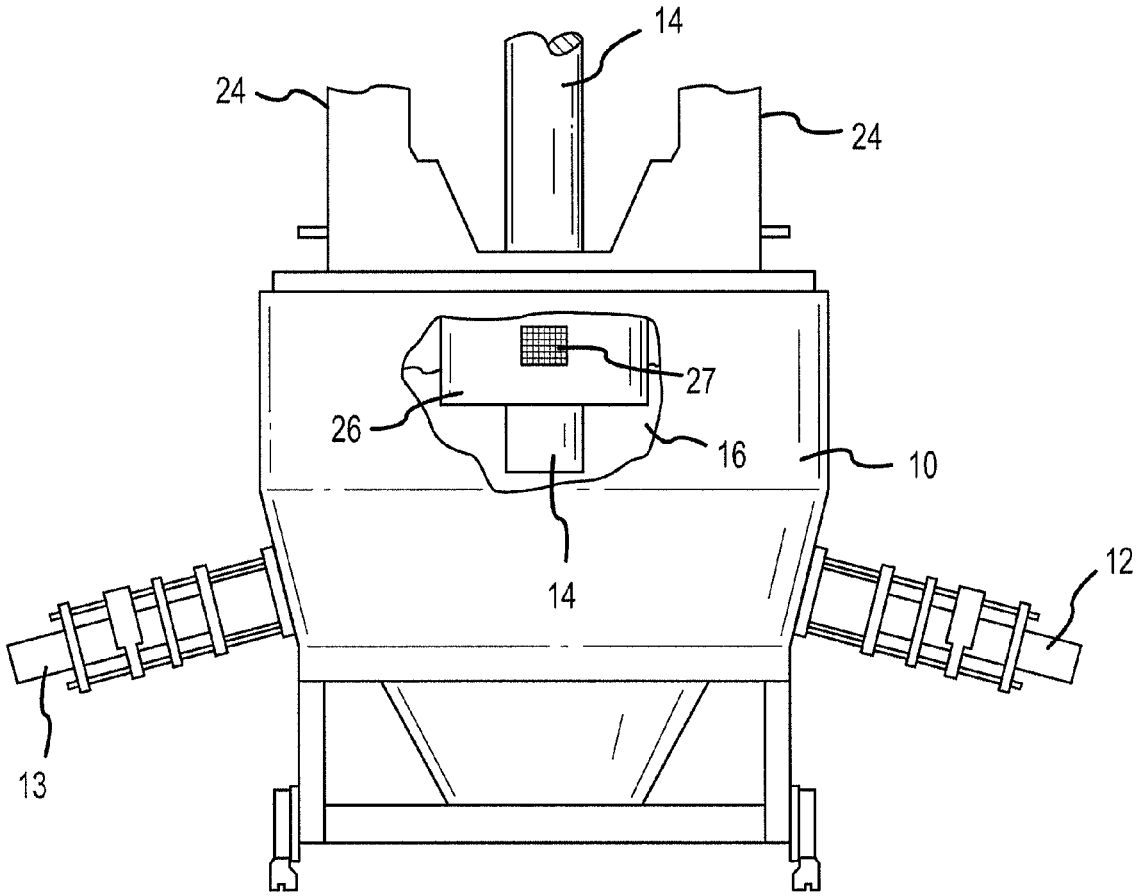
FIG. 7 is a side view of the carbothermic reactor of FIG. 6 having a cut-away portion illustrating internal features.

As illustrated in FIGS. 1, 6 and 7, one or more apertures 27 ("aperture(s)") may be provided in the inner wall 26. In particular, the aperture(s) 27 may be in fluid communication with the port 21. Hence, pressure build-up within the reactor 1 may be reduced as off-gas G may exit the reactor 1 via the ports 21.

Off-gas G may be in fluid communication with at least a portion of the feedstock supply path. Thus, off-gas G generated during operation of the reactor 1 may flow into the feedstock supply path and may interact with feedstock 22 contained therein. In particular, aluminum species (e.g., $Al_2O$, Al) of the off-gas may physically interact with the feedstock 22, such as via condensation on the surface of the feedstock 22, thereby removing at least a portion of the aluminum species from the off-gas G. The aluminum species may also chemically interact with the feedstock 22, such as reaction with carbonaceous materials to produce aluminum carbide/slag, thereby removing at least a portion of the aluminum species from the off-gas G. Aluminum species of the off-gas G may also condense on the outer perimeter OP of the inner wall 26. In turn, inefficiencies due to aluminum vapor losses may be reduced.

As illustrated, the top-entering electrode 14 is of a cylindrical construction. In other embodiments, other configurations may be utilized (e.g., rectangular-solid). In a particular embodiment (not illustrated), the top-entering electrode is tubular. In this embodiment, electrical current may pass through the solid portion of the tubular top-entering electrode, and feedstock 22 may pass into the reactor 1 via the hollow inner portion of the tubular top-entering electrode. In this embodiment, the diameter of the tube could be tailored so as to achieve a desired feed rate of feedstock 22 to the reactor 1. Feedstock exiting the tip of the tubular top-entering electrode may thus be pre-heated and may readily liquefy upon entering the molten bath 16.

Figure 8A:
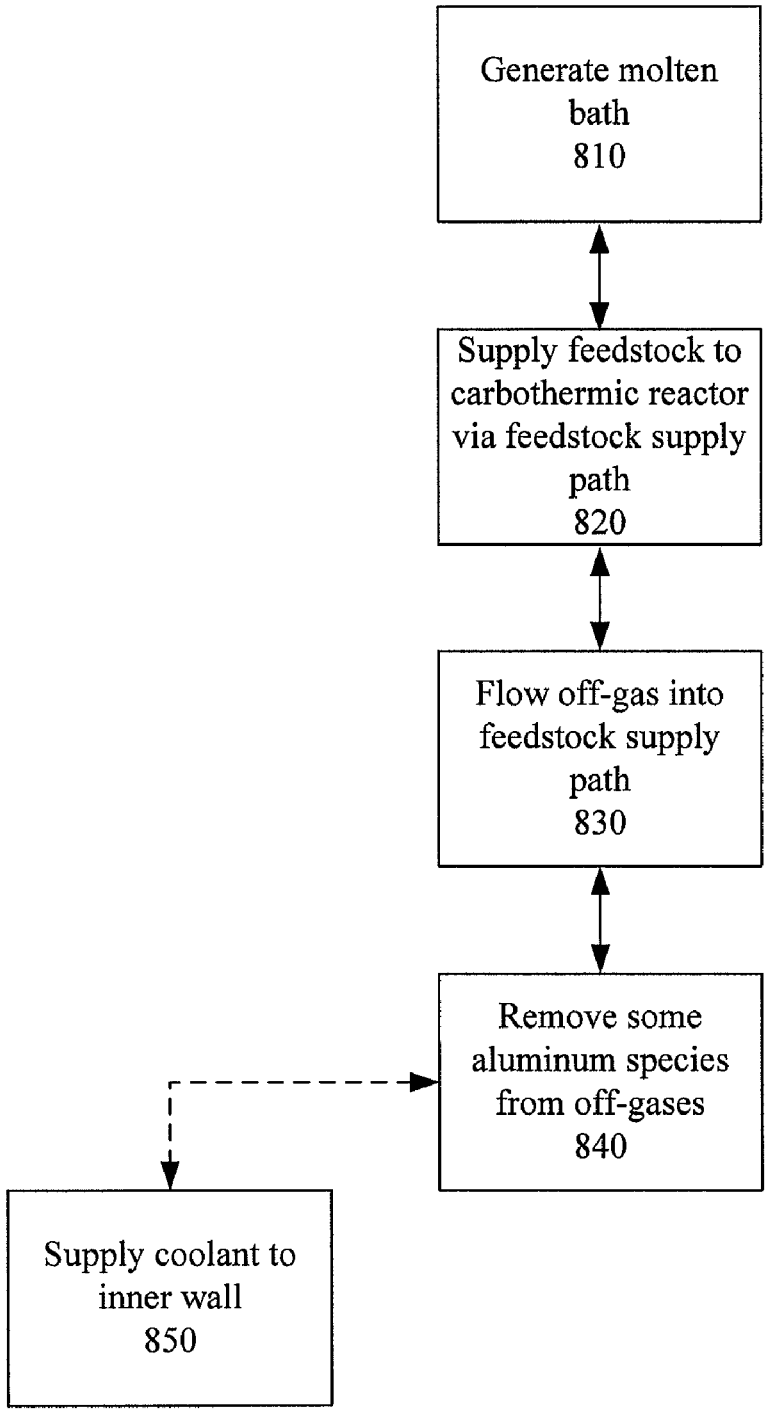
FIG. 8*a* is a flow diagram illustrating one embodiment of a method for operating a carbothermic reactor.

Methods of operating a carbothermic aluminum production reactor are also provided, one embodiment of which is illustrated in FIG. 8*a*. In this embodiment, the method generally includes the steps of generating a molten bath in a carbothermic aluminum production reactor (810), supplying feedstock to the carbothermic reactor via a feedstock supply path (820), flowing off-gas into the feedstock supply path (830), and removing aluminum species from the off-gas (840). The method may also optionally include the step of supplying coolant to an inner wall of the carbothermic reactor (850). These steps may be accomplished in serial or in parallel. Hence, one or more of these steps may be accomplished concomitant to one or more other steps.

Figure 8B:
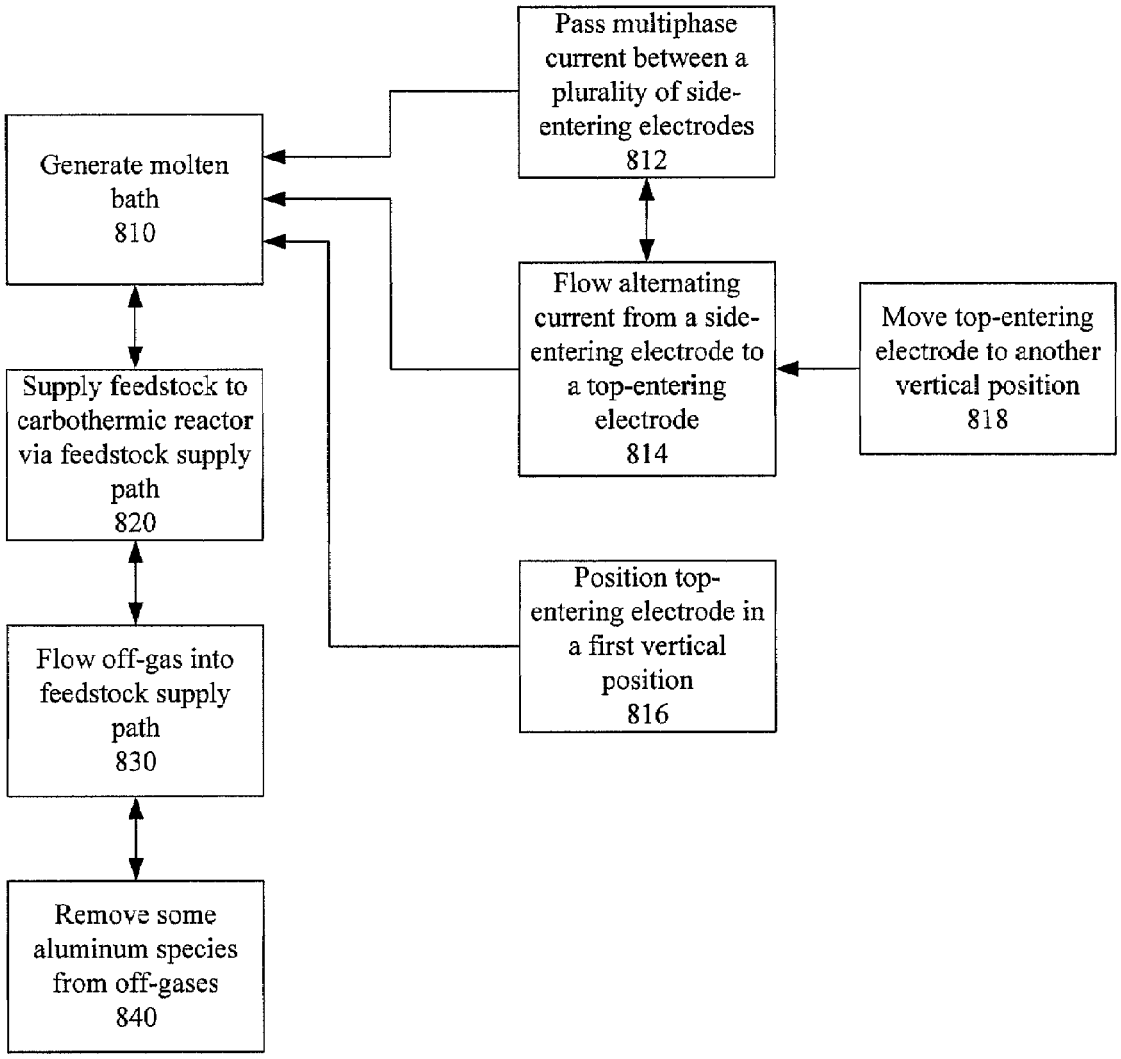
FIG. 8*b* is a flow diagram illustrating one embodiment of a method for operating a carbothermic reactor.

As illustrated in FIG. 8*b*, the generating molten bath step (810) may comprise the step of passing multiphase current between a plurality of side-entering electrodes (812), the side-entering electrodes being in communication with the molten bath. The molten bath may include at least one of aluminum metal, aluminum carbide and slag. Off-gas may be produced during the generating molten bath step (810). The off-gas may include aluminum species and carbon monoxide. The generating molten bath step (810) may include the step of flowing alternating current from at least one of the side-entering electrodes to the top-entering electrode (814). For example, during the flowing the alternating current step (814), the top-entering electrode may be positioned in a first vertical position (816), thereby flowing a first amount of alternating current to the top-entering electrode (e.g., none or some alternating current). In turn, the top-entering electrode may be moved to a second vertical position (818), where a second amount of alternating current (e.g., some or most of the alternating current) may flow to the top-entering electrode. Thus, varying current distribution within the molten bath may be facilitated.

Figure 8C:
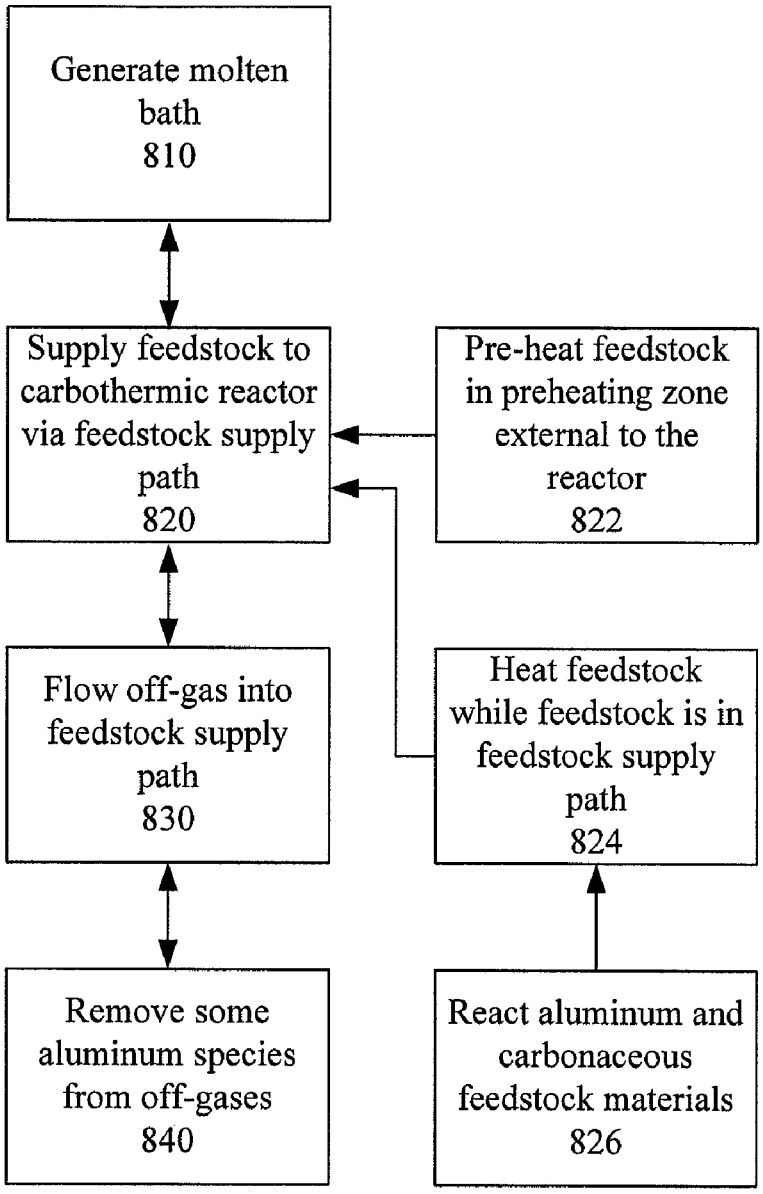
FIG. 8*c* is a flow diagram illustrating one embodiment of a method for operating a carbothermic reactor.

As noted, the method may include the step of supplying feedstock to the carbothermic reactor via a feedstock supply path. The feedstock supply path may be at least partially defined by a port of a cover of the carbothermic reactor, a top-entering electrode communicable with the molten bath, and an inner wall circumscribing the top-entering electrode. As illustrated in FIG. 8*c*, the supplying feedstock step (820) may include the step of preheating the feedstock in a preheating zone located external to the reactor (822), such as via the feeder 24, noted above. In this regard, the feedstock may be heated to a temperature in the range of 100° C. to 600° C. in the preheating zone. The supplying feedstock step (820) may include the step of heating the feedstock while the feedstock is in the feedstock supply path (824). In this regard, the feedstock may be heated to a temperature of from about 600° C. to about 1900° C. in the feedstock supply path. In turn, alumina oxide of the feedstock may react with carbonaceous material of the feedstock (826) to create various supply materials for the carbothermic reactor, such as aluminum carbide, slag and related materials.

Figure 8D:
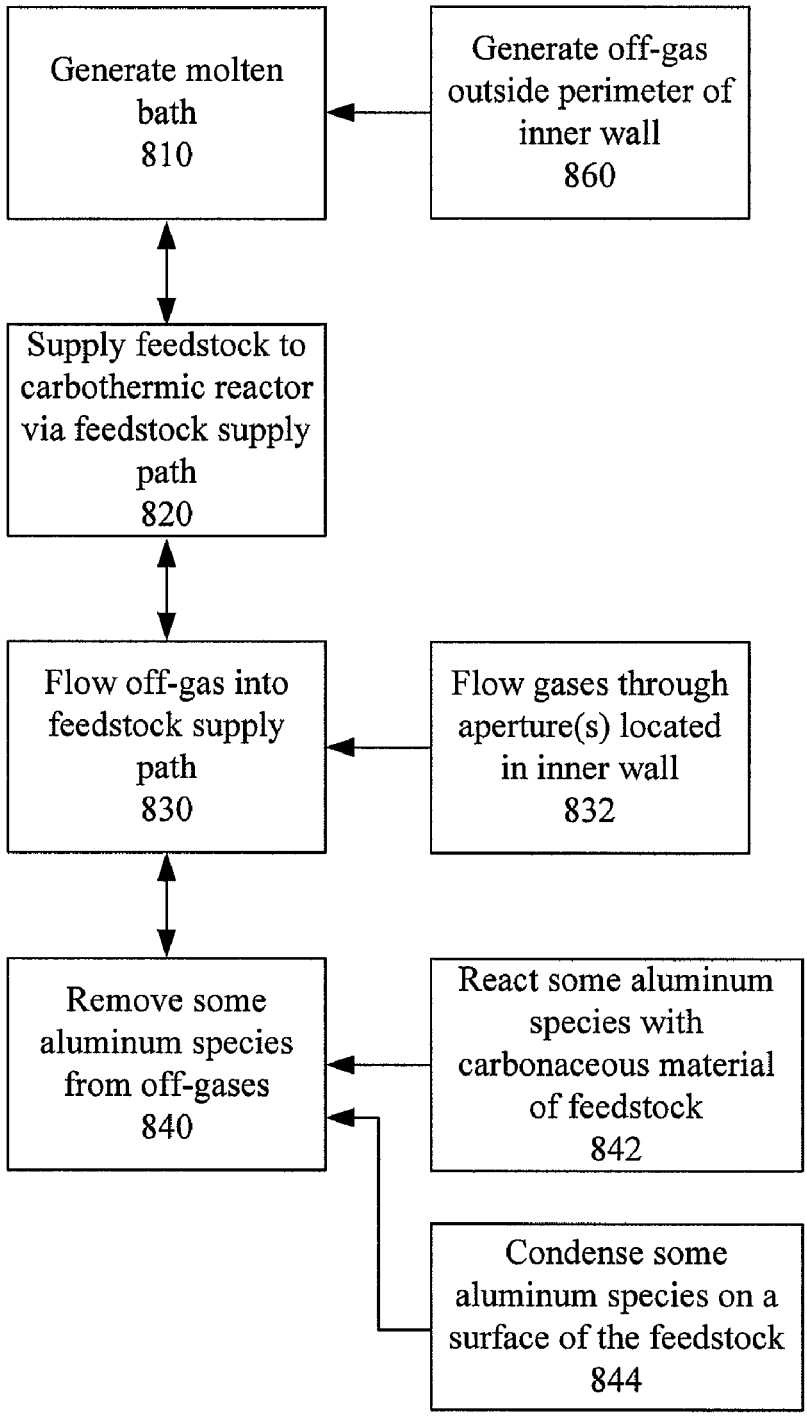
FIG. 8*d* is a flow diagram illustrating one embodiment of a method for operating a carbothermic reactor.

As illustrated in FIG. 8*d*, the generating molten bath step (810) may include the step of generating a first portion of off-gas outside the perimeter of the inner wall (860). In turn, the flowing the off-gas into the feedstock supply path step (830) may include flowing at least some of the first portion of the off-gas into the feedstock supply path via about one or more apertures located in the inner wall (832).

The step of removing aluminum species from the off-gas (840) may be accomplished in various manners. In one embodiment, at least some of the aluminum species are reacted with carbonaceous material in the feedstock (842), thereby producing recyclable material (e.g., aluminum carbide, slag) for resupply to the carbothermic reactor. In another embodiment, at least some of the aluminum species may be condensed on a surface of the feedstock (844). Hence, aluminum vapor losses may be restricted.

While various embodiments of the present disclosure have been described in detail, it is apparent that modifications and adaptations of those embodiments will occur to those skilled in the art. However, it is to be expressly understood that such modifications and adaptations are within the spirit and scope of the present disclosure.

What is claimed is:

1. A system comprising:

a carbothermic reactor comprising:

a chamber adapted to contain a molten bath, the chamber being at least partially defined by an outer shell and a floor of the carbothermic aluminum production reactor;

a first set of side-entering electrodes penetrating the outer shell and in communication with the chamber;

a second set of side-entering electrodes penetrating the outer shell and in communication with the chamber;

a single top-entering electrode in communication with the chamber, wherein the top-entering electrode is moveable in the up-down directions; and a cover substantially covering the chamber, wherein the cover comprises a first port for receiving the single top-entering electrode, and wherein the cover comprises at least one additional port for receiving feedstock to be fed to the chamber; and an electrical supply in electrical communication with the first and second sets of side-entering electrodes, wherein the electrical supply is adapted to supply a different voltage phase to each electrode of the first set of side-entering electrodes or impose phase shifting on each electrode of the first set of side-entering electrodes; and wherein the electrical supply is adapted to supply a different voltage phase to each electrode of the second set of side-entering electrodes or impose phase shifting on each electrode of the second set of side-entering electrodes.

2. The system of claim 1, wherein, during operation of the reactor, when the top-entering electrode is in a first position, current passes through the molten bath in delta configuration.

3. The system of claim 2, wherein, during operation of the reactor, when the top-entering electrode is in a second position, current passes through the molten bath in a Wye configuration.

4. The system of claim 1, further comprising:

an inner wall interconnected with the cover and extending toward the floor of the reactor, wherein the inner wall at least partially circumscribes a portion of the top-entering electrode.

5. The system of claim 4, wherein the inner wall is interconnected with a cooling supply system.

6. The system of claim 4, wherein the inner wall comprises at least one aperture, wherein the at least one aperture is in fluid communication with the at least one additional port of the cover, thereby facilitating passage of off-gas from the chamber to the at least one additional port during operation of the reactor.

7. The system of claim 6, further comprising:

a feeder fluidly interconnected with the at least one additional port, wherein the feeder is operable to feed the feedstock to the reactor via the at least one additional port, thereby facilitating interaction between off-gas exiting the reactor and feed materials entering the reactor.

8. The system of claim 7, wherein the feeder comprises a moveable member located proximal the at least one additional port, wherein the moveable member is operable to push the feedstock into the at least one additional port.

9. The system of claim 7, wherein the feeder comprises a heater for preheating the feed materials prior to supply to the reactor.

10. The system of claim 7, wherein the feeder comprises a hopper.

11. The system of claim 4, wherein a bottom portion of the inner wall is submerged in the molten bath.

12. The system of claim 11, wherein the inner wall at least partially segregates the top-entering electrode from molten aluminum metal of the molten bath.

13. The system of claim 4, wherein an annular space exists between an outer surface of the top-entering electrode and the inner wall.

14. The system of claim 1, wherein the first set of side-entering electrodes is aligned with a first horizontal plane, and wherein the second set of side-entering electrodes is aligned with a second horizontal plane, wherein the first horizontal plane is different than the second horizontal plane.

15. The system of claim 14, wherein the first horizontal plane is located above the second horizontal plane.

16. The system of claim 14, wherein the second horizontal plane is located above the first horizontal plane.

17. The system of claim 1, wherein the electrodes of the first set of side-entering electrodes are spaced equidistance from one another about the perimeter of the outer shell, and wherein the electrical supply is operable to supply an adjustable amount of each voltage phase to each electrode.

18. The system of claim 1, further comprising:

a third set of side-entering electrodes penetrating the outer shell and in communication with the chamber; and a fourth set of side-entering electrodes penetrating the outer shell and in communication with the chamber.

19. The system of claim 18, wherein the third set of side-entering electrodes is horizontally aligned with the first set of side-entering electrodes, and wherein the fourth set of side-entering electrodes is horizontally aligned with the second set of side-entering electrodes.

* * * * *